US005145739A

United States Patent [19]

Sarin

[11] Patent Number: 5,145,739

[45] Date of Patent: Sep. 8, 1992

[54] ABRASION RESISTANT COATED ARTICLES

[76] Inventor: Vinod K. Sarin, 7 Diamond Rd., Lexington, Mass. 02173

[21] Appl. No.: 553,248

[22] Filed: Jul. 12, 1990

[51] Int. Cl.[5] ..... B32B 7/02

[52] U.S. Cl. ..... 428/336; 51/295; 51/307; 51/309; 428/457; 428/469; 428/472; 428/697; 428/698; 428/699

[58] Field of Search ..... 428/698, 697, 699, 457, 428/469, 472, 336; 51/295, 307, 309; 76/DIG. 11; 75/203; 148/425; 407/119

[56] References Cited

U.S. PATENT DOCUMENTS

| | | | |
|---|---|---|---|
| 3,909,895 | 10/1975 | Abrahamson et al. | 407/119 |
| 4,150,195 | 4/1979 | Tobioka et al. | 75/203 |
| 4,252,862 | 2/1981 | Nishida | 428/457 |
| 4,359,335 | 11/1982 | Garner | 428/698 |
| 4,406,667 | 9/1983 | Sarin et al. | 51/295 |
| 4,406,668 | 9/1983 | Sarin et al. | 51/295 |
| 4,406,669 | 9/1983 | Sarin et al. | 51/295 |
| 4,409,003 | 10/1983 | Sarin et al. | 51/295 |
| 4,409,004 | 10/1983 | Sarin et al. | 51/295 |
| 4,416,670 | 11/1983 | Sarin et al. | 51/295 |
| 4,421,525 | 12/1983 | Sarin et al. | 51/295 |
| 4,424,066 | 1/1984 | Sarin et al. | 51/295 |
| 4,426,209 | 1/1984 | Sarin et al. | 51/295 |
| 4,431,431 | 2/1984 | Sarin et al. | 51/295 |
| 4,435,480 | 3/1984 | Mizuhara | 428/698 |
| 4,440,547 | 4/1984 | Sarin et al. | 51/295 |
| 4,441,894 | 4/1984 | Sarin et al. | 51/295 |
| 4,449,989 | 5/1984 | Sarin et al. | 51/295 |
| 4,469,489 | 9/1984 | Sarin et al. | 51/295 |
| 4,497,874 | 2/1985 | Hale | 428/698 |
| 4,507,151 | 3/1985 | Simm et al. | 75/251 |
| 4,526,618 | 7/1985 | Keshaven et al. | 106/1.05 |
| 4,556,607 | 12/1985 | Sastri | 148/425 |
| 4,588,605 | 5/1986 | Keshavan et al. | 427/34 |
| 4,698,266 | 10/1987 | Buljan et al. | 428/457 |
| 4,701,384 | 10/1987 | Sarin et al. | 428/698 |
| 4,702,970 | 10/1987 | Sarin et al. | 428/698 |
| 4,705,124 | 11/1987 | Abrahamson et al. | 76/DIG. 11 |
| 4,710,425 | 12/1987 | Baldoni, II et al. | 428/328 |
| 4,745,010 | 5/1988 | Sarin et al. | 427/255 |
| 4,749,629 | 6/1988 | Sarin et al. | 428/698 |
| 4,751,109 | 6/1988 | Sarin et al. | 427/255 |
| 4,844,951 | 7/1989 | Sarin et al. | 427/255 |

FOREIGN PATENT DOCUMENTS

| | | |
|---|---|---|
| 0138228 | 4/1985 | European Pat. Off. . |
| 0263747 | 4/1988 | European Pat. Off. . |
| 4832734 | 5/1973 | Japan . |
| 51-66289 | 6/1976 | Japan . |
| 56-152541 | 11/1981 | Japan . |
| 58-209554 | 12/1983 | Japan . |
| 2179678 | 3/1987 | United Kingdom . |

OTHER PUBLICATIONS

"Characterisation and Wear Performance of Plasma Sprayed WC-Co Coatings", Ramnath et al., Materials Sciences and Technology, 5, p. 382 (1989).

"Applying Tungsten Carbide Cobalt Coatings by High Velocity Combustion Spraying", Barbezat et al., Sulzer Technical Review, 4, p. 4 (1988).

"A Technical Assessment of High Velocity Oxygen-Fuel Versus High Energy Plasma Tungsten Carbide-Cobalt Coatings for Wear Resistance", Dorfman et al., Conference: Thermal Spraying, The Welding Institute, 2, p. 291 (1989).

(List continued on next page.)

*Primary Examiner*—Ellis P. Robinson
*Assistant Examiner*—Archene A. Turner
*Attorney, Agent, or Firm*—Choate, Hall & Stewart

[57] ABSTRACT

The invention provides pore-free, dense refractory metal binder composite and laminate coated articles including ceramic or cemented carbide substrates coated with refractory metal carbide, nitride, or carbonitride binder composite coatings. A tungsten carbide cobalt composite coated tungsten carbide cobalt article is provided. Refractory metal carbide, nitride and carbonitride binder composite layers and/or refractory metal carbide, nitride and carbonitride layers can be combined with binder layers to construct laminate coated articles. Among such laminate coated articles are structures which include at least one layer of tungsten carbide cobalt composite and at least one layer of cobalt on a tungsten carbide cobalt substrate.

17 Claims, 2 Drawing Sheets

OTHER PUBLICATIONS

"Production and Properties of Wear-Resistant Coatings with the Aid of Plastic-Bonded Hard Metal/Solder Shapes", Krappitz et al., Conference: Welding and Cutting '88, Deutscher Verband fur Schweisstechnik, pp. 45-49 (1988).

"A Unique Alternative to Carbide, Tool Steel and Flame Sprayed Wear Surfaces", Reeder, Powder Metallurgy International, 19, p. 39 (1987).

"New Materials in Plant Construction for the Gas and Petroleum Industries", Belousov, Chemical and Petroleum Engineering, 10, p. 230 (1974).

"Growth and Structure of Tungstein Carbide-Transition Metal Superlattices", Moustakas et al., Materials Research Society Symp. Proc., 103, p. 41 (1988).

"HfN Coatings for Cemented Carbides and New Hard-Facing Alloys on the Basis (Mo,W)C—$(Mo,W)_2C$*", Rudy et al., Planseeberichte Fur Pulvermetallurgie, 26, p. 105 (1978).

"Tribological Properties of Ion Planted Coatings", Berger et al., IPAT 89—Ion and Plasma Assisted Techniques—7th International Conference, p. 262 (1989).

"Wear Resistant Coatings Made by Chemical Vapor Deposition", Perry et al., AGARD, NATO, LS-106, pp. 1-12 (1980).

"High Stress Abrasion of Carbidic Hardfacing Alloys", Leech, Surface Engineering, 5, p. 41 (1989).

"Cemented Carbide Cutting Tools", Sarin, Advances in Powder Technology, Materials Science Seminar, Louisville, Ky., ed. Gilbert Y. Chin, 253 (1981).

"Application and Manufacture of CVD Hard-Facing Layers for Cutting Non-Cutting Shaping", Schintlmeister et al., Metall, 34, pp. 905-909 (1980).

"Peculiarities of Wear Behaviour of Coated Cemented Carbides", Berger et al., Fifth Polish Conf. on Powder Metallurgy (Proc. Conf.) Poznan, Poland, (III), pp. 71-90, (1979).

"The Results of Roughness and Wear Tests on Wear-Resistant Coatings", Habig et al., Hart.-Tech. Mitt., 40, pp. 283-295 (1985).

ABRASION RESISTANT COATED ARTICLES

BACKGROUND OF THE INVENTION

The invention relates to abrasion resistant coated articles.

Metal cutting and other wear applications require cutting tools and abrasive materials with particular surface and bulk properties. The tool surface must be chemically inert and resistant to mechanical wear, while the bulk material must be tough and resistant to plastic deformation, as well as to crack generation and propagation. These requirements have been satisfied by substrate and applied coating optimization.

Titanium and its alloys present particular challenges for cutting tool design. Titanium is characterized by a low thermal conductivity, a low specific heat, and a high melting point. These properties result in high cutting temperatures even at moderate cutting speeds. Furthermore, titanium displays high chemical reactivity and so far no coated cutting tools have been successful for titanium machining. Currently, the best available tool material for titanium machining is cemented tungsten carbide cobalt (WC-Co), which maintains shape integrity only at extremely low cutting speeds. Cutting tools are needed capable of machining titanium and other hard to machine materials at high speeds and feed rates.

SUMMARY OF THE INVENTION

The invention provides for coated articles for tribological applications including substrates to which refractory metal carbide binder composite coatings, laminated coatings, and laminated coatings which include refractory metal carbide binder composite layers have been applied.

In its several aspects, the invention provides for coated articles which can be classified for convenience of description. Articles which consist generally of substrates to which refractory metal carbide, nitride, or carbonitride binder composite coatings have been applied are designated as Type 1 articles. The term "binder" designates a metal or metal alloy wherein carbide, nitride, or carbonitride phases such as tungsten carbide (WC), are cemented together. A composite is a material consisting of particles which can have a variety of shapes, i.e. spherical, rod, disk, or whisker morphology interconnected in a binder. Cutting tool substrates can include cemented carbides, tool steels, or ceramics based on $Al_2O_3$, silicon nitride, silicon carbide or $ZrO_2$.

In one aspect of the invention, a coated article consisting of a WC-Co-$\gamma$ substrate coated with tungsten carbide cobalt (WC-Co) is provided.

Several other aspects of the invention provide for articles which include substrates to which alternating layer laminated coatings, at least one layer of which is a refractory metal carbide layer, refractory metal nitride layer or refractory metal carbonitride layer and at least one of which is a binder layer have been applied. We designate these articles as Type 2 articles.

In another aspect of the invention, articles for tribological and cutting applications include substrates which can be ceramics such as SiC and $Si_3N_4$ coated with laminated layers at least one of which is a refractory metal carbide binder composite layer and at least one of which is a non-pure nickel binder layer. We designate these articles as Type 3 articles.

In one aspect of the invention, a tungsten carbide cobalt composite substrate is coated with laminated layers, at least one of which is a tungsten carbide cobalt composite layer and at least one of which is a cobalt or cobalt alloy layer. In another aspect of the invention, a tungsten carbide cobalt material is coated with laminated layers, at least one of which is a tungsten carbide layer and at least one of which is a cobalt or cobalt alloy layer.

In preferred embodiments of Type 1, 2, and 3 articles, the refractory metal can be titanium, vanadium, chromium, zirconium, niobium, molybdenum, hafnium, tantalum, or tungsten. In other preferred embodiments, the substrate can be a cemented carbide such as titanium, vanadium, chromium, zirconium, niobium, molybdenum, hafnium, tantalum, or tungsten carbide and combinations of these elements cemented with a binder such as nickel, cobalt, tungsten, molybdenum and alloys of these elements. In other embodiments, the substrate can be a monolithic or composite ceramic such as silicon nitride, aluminum oxide, partially stabilized zirconia (PSZ), or transformation toughened zirconia (TTZ). Also, a metal substrate such as tool steel can be used. Further, in other embodiments, the single layer composite coatings are in a preferred range 5–10 microns thick and the individual layers of the laminated coatings are in the range 10 Å–0.5 microns thick.

The aspect of the invention which concerns deposition of a WC-Co coating on a specific engineered substrate, such as WC-Co or WC-Co and cubic carbides (WC-Co-$\gamma$) can be used to fabricate cutting tools with improved high temperature stability, resistance to tool nose deterioration and abrasion, as well as good shape retention at high machining speeds and temperatures and chemically inert surfaces. By selectively exploiting the differing characteristics of specific substrates coated with the composite and multilayer coatings of the invention, it is possible to design cutting tools meeting the demands of particular machining tasks.

DESCRIPTION OF THE PREFERRED EMBODIMENT

Careful selection of substrate material and applied coating can aid in the design of highly abrasion resistant articles useful for machining of titanium and other difficult to machine materials.

Figure 1:
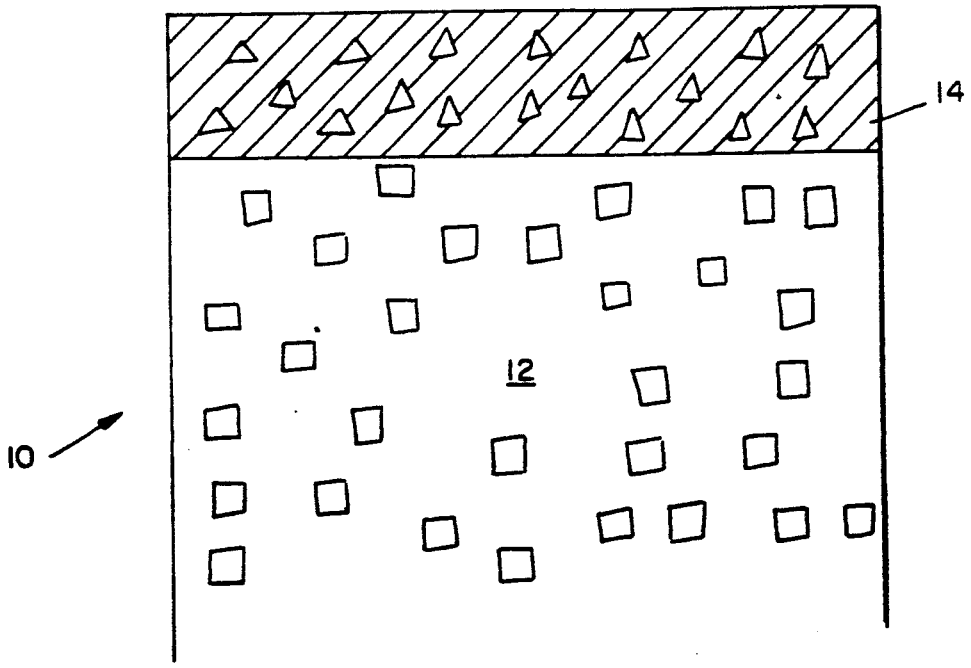
FIG. 1 is a tungsten carbide cobalt (WC-Co) composite coated tungsten carbide cobalt and cubic carbide (WC-Co-$\gamma$) composite article.

In a preferred embodiment, FIG. 1, an abrasion resistant article 10 is composed of a tungsten carbide cobalt and cubic carbide (WC-Co-$\gamma$) substrate 12 and tungsten carbide cobalt (WC-Co) composite coating 14. Alternatively, a monolithic or composite ceramic body with an appropriate sintering aid can serve as a substrate. The tungsten carbide cobalt composite coating can also include cubic carbide or ceramic precipitates. Substrate 12 provides for high temperature shape stability while coating 14 is wear resistant and chemically stable, qualities which combine to yield an abrasion resistant coated article suitable as a cutting tool. Such a tool maintains its shape integrity and chemical stability during high speed and feed rate machining of difficult to machine materials such as titanium.

Other preferred embodiments of the invention include abrasion resistant coated articles designed for different machining applications. In these preferred embodiments, substrate 12 can be monolithic or composite silicon nitride ($Si_3N_4$), aluminum oxide ($Al_2O_3$), or yttria stabilized zirconia (YSZ). The combination of substrate and coating is optimized according to the application and the material to be cut.

Figure 2:
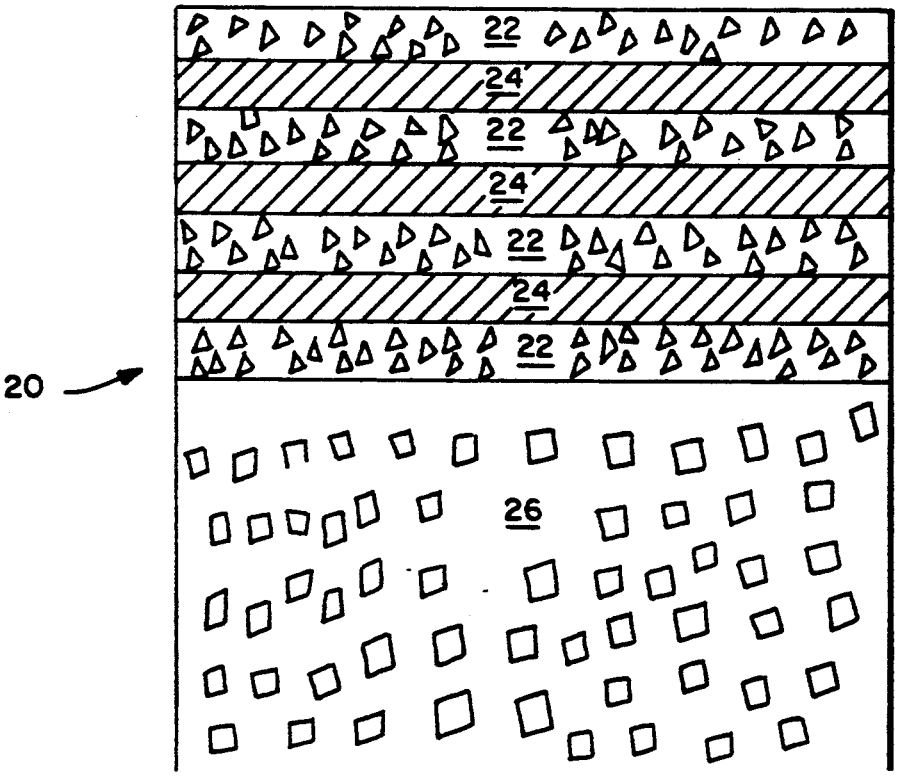
FIG. 2 is a laminate with composite interlayer coated tungsten carbide cobalt and cubic carbide (WC-Co-$\gamma$) article.
Figure 3:
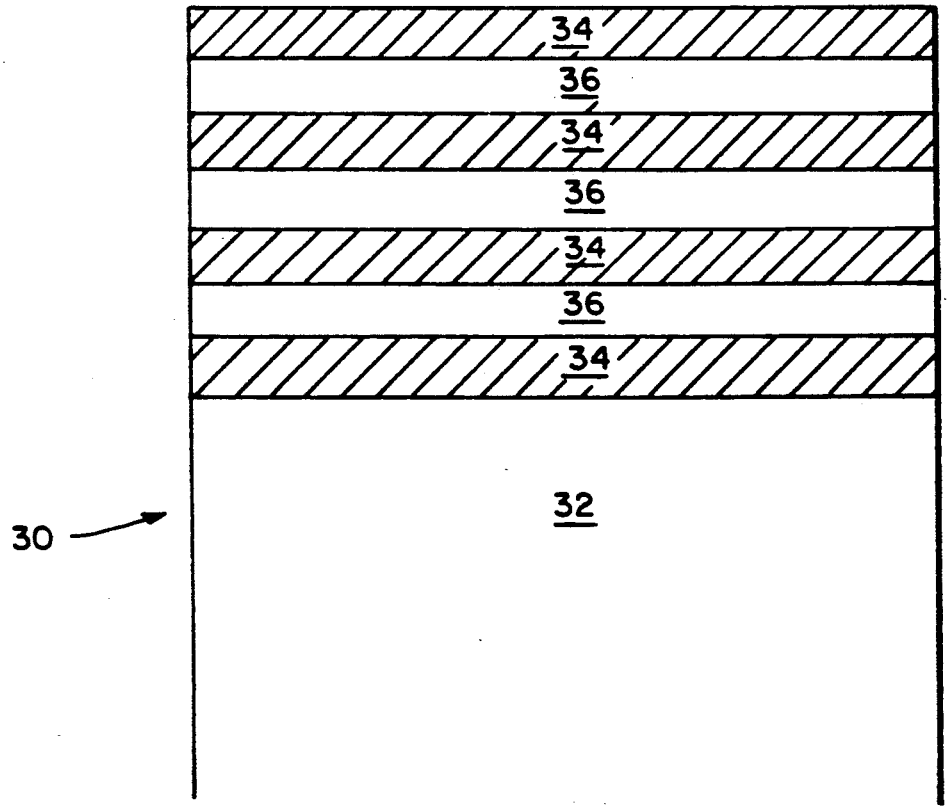
FIG. 3 is a laminate coated tungsten carbide cobalt (WC-Co) article.

FIGS. 2 and 3 show laminate coated abrasion resistant articles 20 and 30. Laminate coated article 20 consists of a sequence of tungsten carbide cobalt composite layers 22 and cobalt layers 24 applied to a WC-Co-γ substrate 26. Abrasion resistant coated article 30 consists of tungsten carbide cobalt (WC-Co) substrate 32, tungsten carbide (WC) layers 34 and cobalt layers 36. WC-Co-γ can also serve as a substrate for article 30.

In other preferred embodiments, substrates other than WC-Co-γ 26 and 32 can be coated with laminated coatings composed of different combinations of refractory metal carbide, nitride, or carbonitride layers, refractory metal carbide, nitride or carbonitride binder composite layers and layers of binder such as cobalt, cobalt alloys, and nickel alloys.

In preferred embodiments, chemical vapor deposition (CVD) processes for production of refractory metal carbide, nitride, and carbonitride binder composite coatings are provided.

In a chemical vapor deposition process for a refractory metal carbide binder composite, gas sources of refractory metal, carbon, and binder, along with hydrogen are reacted at a heated substrate to deposit the refractory metal carbide binder composite coating. Preferred carbon sources are methane and propane.

A refractory metal nitride binder composite chemical vapor deposition process provides refractory metal, nitrogen, and binder containing gases, along with hydrogen, which react at a heated substrate depositing a coating of refractory metal nitride binder composite. Preferred nitrogen sources are ammonia and nitrogen.

In a refractory metal carbonitride binder composite chemical vapor deposition process, reactant gases including refractory metal, nitrogen, carbon, and binder containing gases are allowed to react at a heated substrate resulting in deposition of a refractory metal carbonitride binder material coating on the substrate. Preferred nitrogen or carbon containing gases are respectively ammonia and nitrogen, or methane and propane.

The gaseous refractory metal source can be a refractory metal halide compound and the gaseous binder source can be a binder halide compound. Methane can be used as a carbon containing gas. The deposition reaction can be conducted on a substrate heated to a temperature in the range 600°-1500° C. and at pressures ranging between atmospheric pressure and 5 torr. The reaction temperature is chosen based upon the substrate properties and the maximum temperature which the substrate can withstand.

Interfacial layers can be deposited between substrate and coating or between layers in laminate coatings to promote adhesion needed for specific substrate coating properties. Post-deposition processing can be conducted to optimize coating morphology, including particle size and aspect ratio.

EXAMPLE 1

In a preferred chemical vapor deposition process, a tungsten carbide cobalt (WC-Co-γ) composite coating is deposited on a tungsten carbide cobalt (WC-Co) substrate. $WCl_6$, $CH_4$, $H_2$ and $CoI_2$ react to codeposit a WC-Co or WC-Co-γ composite coating according to the simultaneous reactions $$WCl_6+CH_4+H_2 \rightarrow WC+6HCl$$

$$CoI_2+H_2 \rightarrow Co+2HI$$

on a substrate heated to a temperature in the range 600°-1200° C. at pressures between atmospheric pressure and 5 torr.

EXAMPLE 2

In another preferred chemical vapor deposition process of the invention, tungsten fluoride reacts with hydrogen to deposit a tungsten layer which is then carburized in a hydrogen methane mixture. Cobalt is deposited by reacting cobalt iodide with hydrogen. The chemical reactions which occur at a substrate heated between 600°-1200° C. at pressures between atmospheric pressure and 5 torr are given by the following equations:

$$WF_6+CH_4+H_2 \rightarrow WC+6HF$$

$$CoI_2+H_2 \rightarrow Co+2HI$$

EXAMPLE 3

In a preferred pulsation chemical vapor deposition process, alternating layers of tungsten carbide and cobalt are deposited using a cycle duration of between 2 and 30 minutes for deposition of coatings in the thickness range 2 to 10 Å. A tungsten layer is deposited by introducing $WF_6$ into a reaction chamber along with a carburizing gas according to the following reaction:

$$WF_6+CH_4+H_2 \rightarrow WC+6HF$$

for 10 minutes. Then, the reaction vessel is purged by introduction of an inert gas such as argon for 5 minutes between cycles or for an appropriate time period as determined by reactor shape. After reactor purging is complete, a cobalt layer is deposited by introduction of $CoI_2$ which reacts with hydrogen according to the following reaction:

$$CoI_2+H_2 \rightarrow Co+2HI.$$

These chemical reactions occur at a substrate which can be a ceramic such as a SiN based material heated in the range 700°-1500° C. at pressures between atmospheric pressure and 5 torr.

EXAMPLE 4

In other preferred embodiments, a conventional physical vapor deposition process such as sputtering or laser ablation is used wherein refractory metal carbide, nitride or carbonitride binder composite coatings are deposited by providing a refractory metal carbide, nitride, or carbonitride target, a binder containing target and an ion or laser source which respectively sputters or ablates these targets. Refractory metal carbide, nitride, or carbonitride and binder are codeposited to form a refractory metal carbide, nitride, or carbonitride binder composite coating.

A physical vapor deposition process is provided for deposition of a tungsten carbide cobalt composite coating using a tungsten carbide target and a cobalt containing target which are sputtered or ablated with an ion or laser source, respectively, resulting in codeposition of tungsten carbide and cobalt on a tungsten carbide cobalt substrate.

EXAMPLE 5

Other aspects of the invention provide physical vapor deposition processes for refractory metal carbide, nitride, and carbonitride and binder laminated coatings wherein a target containing a refractory metal and another target containing a binder are provided in a carbon, nitrogen, or carbon and nitrogen containing gas atmosphere wherein they are sputtered or laser ablated sequentially to deposit alternating layers of refractory metal carbide, nitride, or carbonitride and binder or alternating layers of refractory metal carbide, nitride, or carbonitride binder composite and binder on the substrate. Preferred nitrogen and carbon containing gases are respectively ammonia or nitrogen and methane or propane.

In a physical vapor deposition process for alternating layers of tungsten carbide cobalt composite and cobalt binder, a tungsten containing target and a cobalt containing target are provided in a carbon containing gas atmosphere where they are sputtered sequentially, resulting in deposition of alternating tungsten carbide cobalt composite and cobalt binder layers on a tungsten carbide cobalt substrate.

What is claimed is:

1. A coated article comprising:

a substrate selected from the group consisting of cemented carbide, ceramic or metal to which at least one laminar unit is applied, said laminar unit comprising a refractory metal carbide composite layer and a metal or metal alloy binder layer, said laminar unit deposited such that the refractory metal carbide composite layer and the binder layer are in alternating layers, and wherein said coated article possesses good shape retention at high machining speeds and provides improved wear-resistance and chemical inertness.

2. A coated article comprising:

a non-silicon substrate selected from the group consisting of cemented carbide, ceramic or metal to which at least one laminar unit is applied, said laminar unit comprising a refractory metal carbide layer and a non-nickel metal or metal alloy binder layer, said laminar unit deposited such that the refractory metal carbide layer and the binder layer are in alternating layers, and wherein said coated article possesses good shape retention at high machining speeds and provides improved wear-resistance and chemical inertness.

3. A coated article comprising:

a substrate selected from the group consisting of cemented carbide, ceramic or metal to which at least one laminar unit is applied, said laminar unit comprising a tungsten carbide layer and a cobalt layer;

said laminar unit deposited such that the tungsten carbide layer and the cobalt layer are in alternating layers, and wherein said coated article possesses good shape retention at high machining speeds and provides improved wear-resistance and chemical inertness.

4. A coated article comprising:

a substrate selected from the group consisting of cemented carbide, ceramic or metal to which at least one laminar unit is applied, said laminar unit comprising a tungsten carbide composite layer and a cobalt layer;

said laminar unit deposited such that the tungsten carbide composite layer and the cobalt layer are in alternating layers, wherein said coated article possesses good shape retention at high machining speeds and provides improved wear-resistance and chemical inertness.

5. The article of claim 1 or 2 wherein the refractory metal of said refractory metal carbide is one or more refractory metals selected from the group consisting of titanium, vanadium, chromium, zirconium, niobium, molybdenum, hafnium and tungsten.

6. The article of claim 1, 2, 3 or 4 wherein said substrate is a ceramic substrate selected from the group consisting of silicon nitride, aluminum oxide, partially stabilized zirconia (PSZ) and transformation toughened zirconia (TTZ).

7. The article of claim 1 wherein said substrate is a cemented carbide including one or more cubic carbides and tungsten carbide cemented with a metal or metal alloy binder.

8. The article of claim 2 wherein said substrate is a cemented carbide including one or more cubic carbides and tungsten carbide cemented with a metal or metal alloy binder.

9. The article of claim 3 wherein said substrate is a cemented carbide including one or more cubic carbides and tungsten carbide cemented with a metal or metal alloy binder.

10. The article of claim 4 wherein said substrate is a cemented carbide including one or more cubic carbides and tungsten carbide cemented with a metal or metal alloy binder.

11. The article as in any of claims 7, 8, 9 or 10 wherein said cubic carbides are cubic carbides selected from the group consisting of one or more titanium, vanadium, chromium, zirconium, niobium, molybdenum, hafnium and tantalum cubic carbides.

12. The article as in any of claims 7, 8, 9 or 10 wherein said binder is selected from the group consisting of nickel, cobalt, tungsten, molybdenum and their alloys.

13. The article of claim 1 wherein said binder is a binder selected from the group consisting of nickel, cobalt, tungsten, molybdenum and their alloys.

14. The article of claim 1, 2, 3 or 4 wherein said substrate is a tool steel.

15. The article of claim 2 wherein said binder is a binder selected from the group consisting of cobalt, tungsten, or molybdenum and their alloys.

16. The article of claim 4 wherein said tungsten carbide composite layer has a chemical composition in the range 99–75% by weight WC and 1–25% by weight Co.

17. The article of claim 1, 2, 3 or 4 wherein said layers are in a range of 10 Å–1.5 microns thick.

* * * * *

UNITED STATES PATENT AND TRADEMARK OFFICE

CERTIFICATE OF CORRECTION

PATENT NO. : 5,145,739

DATED : September 8, 1992

INVENTOR(S) : Vinod K. Sarin

It is certified that error appears in the above—identified patent and that said Letters Patent is hereby corrected as shown below:

Column 2, line 12-13: delete "tantalum,";

Column 2, line 16: delete "tantalum,";

Column 3, line 58: delete "C." and insert therefor -- C --;

Column 4, line 15: delete "C." and insert therefor -- C --;

Column 4, line 25: delete "C." and insert therefor -- C --;

Column 4, line 56: delete "C." and insert therefor -- C --; and

Column 6, line 34: delete "including" and insert therefor -- consisting of --.

Signed and Sealed this

Twenty-third Day of November, 1993

*Attest:*

Bruce Lehman

BRUCE LEHMAN

*Attesting Officer*

*Commissioner of Patents and Trademarks*